US011817281B2

(12) United States Patent
Gopalan et al.

(10) Patent No.: US 11,817,281 B2
(45) Date of Patent: Nov. 14, 2023

(54) INDUCTANCE MEASUREMENT TO DETECT FUSED RELAY CONTACTS

(71) Applicant: Texas Instruments Incorporated, Dallas, TX (US)

(72) Inventors: Anand Gopalan, Dallas, TX (US); Nicholas Oborny, Plano, TX (US); Milos Acanski, Freising (DE)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 17/680,119

(22) Filed: Feb. 24, 2022

(65) Prior Publication Data

US 2023/0268153 A1 Aug. 24, 2023

(51) Int. Cl.

| | |
|---|---|
| ***H01H 47/32*** | (2006.01) |
| ***H01H 47/00*** | (2006.01) |
| ***H01H 85/30*** | (2006.01) |

(52) U.S. Cl.

CPC ..... *H01H 47/002* (2013.01); *H01H 47/32* (2013.01); *H01H 85/30* (2013.01); *H01H 2047/003* (2013.01)

(58) Field of Classification Search

CPC ..... H02M 3/155–156; H02M 3/145; H02M 3/158; H02M 3/1582–1588; H01H 47/325; H01H 47/002; H01H 47/04; H01H 47/32; H01H 47/22; H01H 47/10; H01H 85/30; H01H 2047/003

See application file for complete search history.

(56) References Cited

U.S. PATENT DOCUMENTS

| | | | | |
|---|---|---|---|---|
| 7,079,368 | B2 * | 7/2006 | Ishikawa | H03K 17/0822 361/93.1 |
| 2011/0228438 | A1 * | 9/2011 | Kohri | H01H 1/0015 361/187 |
| 2020/0153429 | A1 * | 5/2020 | Butenhoff | H03K 17/166 |

OTHER PUBLICATIONS

Long, "Switching Inductive Loads with Safe Demagnetization," Application Note 6307 (Maxim Integrated Products, Inc., 2014).

"DRV89xx0Q1 Automotive Multi-Channel Half-Bridge Drivers with Advanced Diagnostics," Datasheet SLVSEC9C (Texas Instruments Incorporated, Feb. 2020), pp. 1-64, 129-.

(Continued)

*Primary Examiner* — Bryan R Perez

(74) *Attorney, Agent, or Firm* — John R. Pessetto; Frank D. Cimino

(57) ABSTRACT

A method of detecting welded contacts in a relay. The method includes performing, at a first point in time, the applying of a drive to the activation coil to conduct a coil current through the activation coil, the coil current increasing to a first current level, the first current level being less than a pull-in current of the relay; responsive to the coil current reaching the first current level, turning off the drive to the activation coil to discharge the coil current at a first clamping voltage; and measuring a first discharge time corresponding to a first inductance from the turning off of the drive to the activation coil to the coil current reaching a second current level, the second current level being less than the first current level. These operations are repeated at a second point in time to obtain a second inductance. Comparison of the first inductance and second inductance determines whether a difference between the first and second inductances exceeds a comparison criterion.

39 Claims, 7 Drawing Sheets

(56) References Cited

OTHER PUBLICATIONS

"Using the Half-Bridge DRV89xx-Q1 as High-Side or Low-Side Switch," Application Brief SLVAF04 (Texas Instruments Incorporated, Oct. 2020).
Dong, "Driving High-Voltage Contactors in EV and HEVs," Technical White Paper SLVAF35 (Texas Instruments Incorporated, Feb. 2021).
Dong, "High-voltage contactor control," Document SLYP693 (Texas Instruments Incorporated, 2020).
"TPS2HB16-Q1 40-V, 16-mOhm Dual-Channel Smart High-Side Switch," Datasheet TPS2HB16-Q1 (Texas Instruments Incorporated, Feb. 2020).

* cited by examiner

INDUCTANCE MEASUREMENT TO DETECT FUSED RELAY CONTACTS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This relates to magnetically-actuated contactor devices such as relays, and is more specifically directed to offline detection of fused contact faults in such devices.

Modern electric vehicles (EVs) and hybrid electric vehicles (HEV) incorporate high power circuits in their power distribution systems, primarily in the circuits for charging the on-board batteries and for providing power from the batteries to the vehicle motors. In conventional HEVs and HEVs, these high power circuits commonly operate at relatively high voltages, for example at nominal voltages ranging from 100V to 200V for hybrid/plug-in hybrid vehicles and from 400V to 800V and higher for electric-only vehicles. The use of high voltage levels, as opposed to high current levels, enable the delivery of more power with less loss over a given diameter (and mass) of copper cable.

Electromechanical switching devices commonly serve as the switches in these high power and high voltage circuits. From a reliability standpoint, these high power switching devices, commonly referred to as high power contactors or relays, are vulnerable to a failure mechanism of terminal or contactor fusing. This mechanism is also referred to as "welding" of the relay contacts, and is often caused by high temperature arcing as the relay contacts are opened. Welded relay contacts can result in functional failure in the high power circuit, in that the circuit contacts cannot open its connection as desired. Replacement of the relay, and perhaps repair or replacement of other components affected by the circuit malfunction, becomes necessary.

It has been observed that the relay driver-side coils of welded relays exhibit a reduced inductance, for example a 10 to 20% reduction, from nominal inductance when the contacts are not welded. This reduction in inductance can be used to detect and diagnose welded relays "off-line," without requiring activation of the relay. In some conventional systems, additional voltage-current ("VI") sensors are incorporated on the "hot" side of the drive circuitry to measure the relay driver-side coil inductance. In another conventional approach, some relays include a built-in sensor to detect the position of the armature on the "hot" side of the relay, and to communicate this position to a controller circuitry at an auxiliary pin on the relay, such that the controller can compare the actual armature position with its intended state. In each of these conventional arrangements, additional circuitry is necessary to detect whether the relay contacts are welded.

It is within this context that the embodiments described herein arise.

BRIEF SUMMARY OF THE INVENTION

According to one aspect, a method of detecting welded contacts in a relay actuated by an activation coil is provided.

The detection method includes performing, at a first point in time, the applying of a drive to the activation coil to conduct a coil current through the activation coil, the coil current increasing to a first current level, the first current level being less than a pull-in current of the relay; responsive to the coil current reaching the first current level, turning off the drive to the activation coil to discharge the coil current at a first clamping voltage; and measuring a first discharge time from the turning off of the drive to the activation coil to the coil current reaching a second current level, the second current level being less than the first current level. The method further includes performing, at a second point in time, applying a drive to the activation coil to conduct a coil current through the activation coil, the coil current increasing to the first current level; responsive to the coil current reaching the first current level, turning off the drive to the activation coil to discharge the coil current at the first clamping voltage; and measuring a second discharge time from the turning off of the drive to the activation coil to the coil current reaching the second current level. Welded contacts in the relay may be detected from a comparison of a first inductance corresponding to the first discharge time to a second inductance corresponding to the second discharge time to determine whether a difference between the first and second inductances exceeds a comparison criterion.

According to another aspect, a relay driver is provided. The relay driver includes one or more drive transistors configured to apply a drive at one or more of a high side terminal and a low side terminal, the high side and low side terminals adapted for coupling to an activation coil of a relay; a clamping device, coupled to the low side terminal and to one or more of a power supply voltage and a circuit ground, and configured to clamp the low side terminal to a selected clamping voltage when the one or more drive transistors are not applying the drive; and an inductance measurement circuit. The inductance measurement circuit includes a first comparator configured to compare a coil current conducted from the low side terminal with a first current level while the one or more drive transistors are applying the drive, and to issue a start signal responsive to the coil current increasing to the first current level, the first current level selected to be less than a pull-in current of the relay; a second comparator configured to compare the coil current conducted from the low side terminal with a second current level while the one or more drive transistors are not applying the drive, and to issue a stop signal responsive to the coil current decreasing to the second current level from the first current level; and a timer for measuring a time elapsed between the start signal and the stop signal, and having an output. A controller is provided to control the one or more drive transistors to stop applying the drive in response to the start signal.

Technical advantages enabled by one or more of these aspects include the efficient implementation of precise and accurate measurement of the inductance of high power relay coils and use of such measurements to detect fused or welded contacts.

Other technical advantages enabled by the disclosed aspects will be apparent to those of ordinary skill in the art having reference to the following specification together with its drawings.

BRIEF DESCRIPTION OF THE SEVERAL VIEWS OF THE DRAWING

The same reference numbers or other reference designators are used in the drawings to illustrate the same or similar (in function and/or structure) features.

DETAILED DESCRIPTION OF THE INVENTION

The one or more embodiments described in this specification are implemented into high power switching systems incorporating electromechanical switching devices, such as electric and hybrid-electric vehicles incorporating high power contactors or relays, as it is contemplated that such implementation is particularly advantageous in that context. However, it is also contemplated that aspects of these embodiments may be beneficially applied in other electromechanical switching applications. Accordingly, it is to be understood that the following description is provided by way of example only and is not intended to limit the true scope of this invention as claimed.

Figure 1:
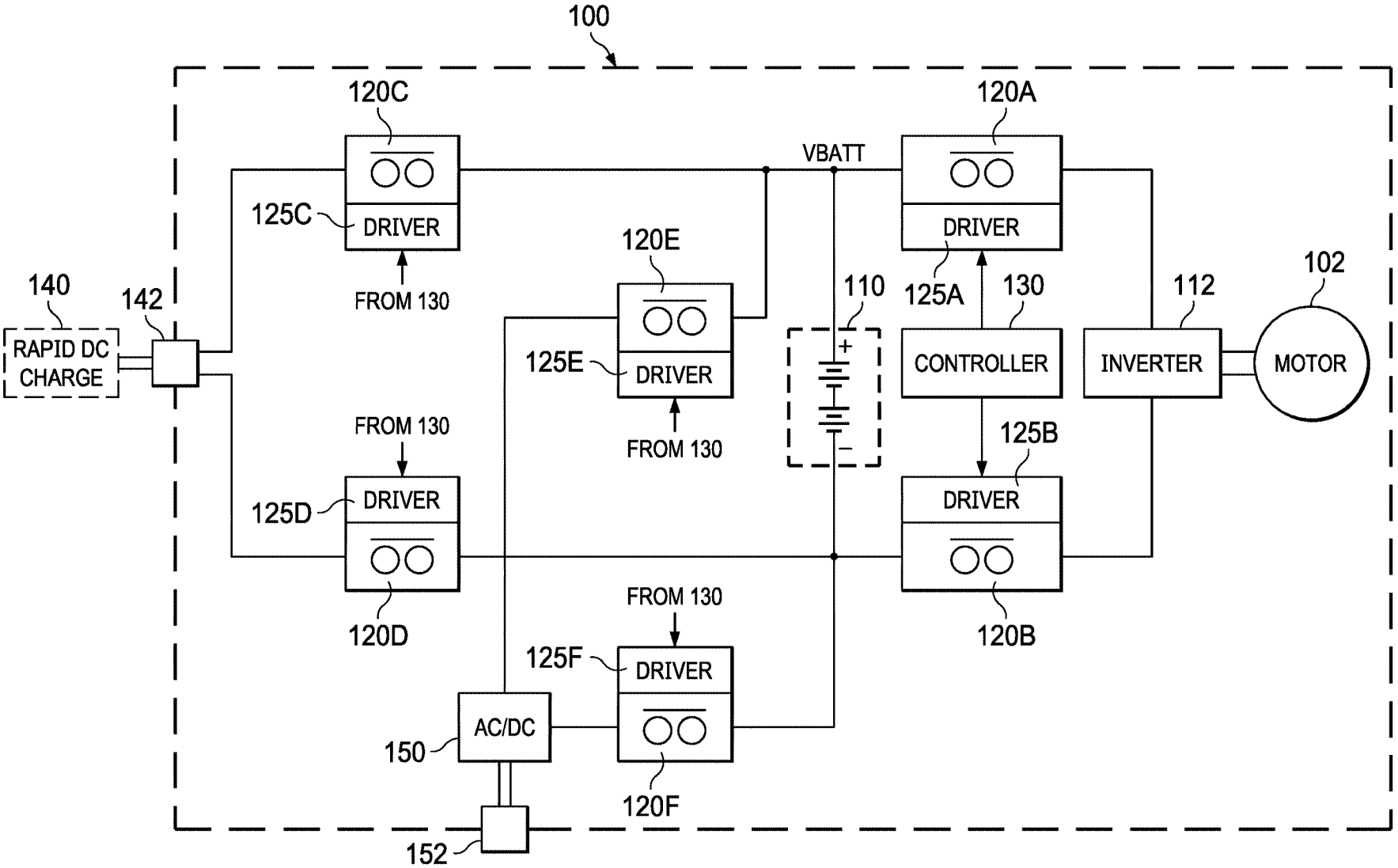
FIG. 1 is an electrical diagram, in block form, of an example architecture of high power contactors and control circuitry in an electric vehicle, in which example embodiments may be implemented.

FIG. 1 illustrates, in a simplified form, the architecture of a battery power system of an electric vehicle (EV) 100, in which the example embodiments described in this specification may be implemented. While the battery power system is shown in FIG. 1 as applied to a fully electrically powered vehicle, a similar architecture may also be incorporated in a hybrid-electric vehicle (HEV). In the architecture shown in FIG. 1, EV 100 is powered by electric motor 102, which may be one of several electric motors providing motive force for EV 100. For example, EV 100 may include multiple (e.g., two, three, or four) motors 102, each powering one or more wheels. Battery pack 110 is provided in EV 100 to store energy for powering electric motor 102. Electric motor 102 in this example is an alternating current (AC) motor, and as such is powered by inverter 112, which converts direct current (DC) power sourced by battery pack 110 to AC power for application to motor 102.

Battery pack 110 in EV 100 of FIG. 1 may be charged in multiple ways. Connection to a "rapid" DC charger 140 external to EV 100 may be made via plug 142. Alternatively, EV 100 includes on-board AC/DC converter 150 for receiving AC power (e.g., conventional household 110 v power) via plug 152, and converting that AC power to DC power for charging battery pack 110. In the case of an HEV (not shown), an on-board generator will also be provided on-board the vehicle to enable charging of battery pack 110 from the internal combustion engine of the vehicle.

Battery pack 110 in EV 100 of FIG. 1 is capable of providing sufficient power to motor 102 and of receiving energy from the various charging systems by way of a number of electromechanical switching devices. In this example embodiment, these electromechanical switching devices are implemented as high power relays 120A through 120F (collectively and/or individually referred to as relay(s) 120). High power relays are also referred to in the art, without distinction, as high power contactors, and as such the terms "contactor" and "relay" will be used interchangeably for purposes of this description. As fundamental in the art, contactors and relays such as high power relays 120 incorporate an inductive coil that, when energized, generates a magnetic force sufficient to mechanically close or open an electric contact.

In the architecture of FIG. 1, each relay 120A through 120F is driven by a corresponding relay driver 125A through 125F, respectively (such relay drivers 125A through 125F collectively and/or individually referred to as relay driver(s) 125). Each relay driver 125 selectively opens and closes its corresponding relay 120, for example in response to signals from controller 130 in EV 100. Controller 130 may be realized as one or more digital logic and/or other computational devices (e.g., as one or more of a processor, controller, microcomputer, memory, and software) in EV 100, such as deployed in a system control module. In this example, relay 120A selectively couples the positive terminal of battery pack 110, at voltage VBATT, to a positive side of inverter 112 under the control of relay driver 125A, and relay 120B selectively couples the negative terminal of battery pack 110 to the negative side of inverter 112 under the control of relay driver 125B. Relays 120C and 120D couple plug 142 for rapid DC charging to the terminals of battery pack 110 under the control of relay drivers 125C, 125D, respectively. Similarly, relays 120E and 120F couple AC/DC converter 150 to the terminals of battery pack 110 under the control of relay drivers 125E, 125F, respectively. The actuation of relays 120 in the drive and charging operations may be controlled by controller 130, for example in response to user input or to the detection of a charging system (rapid DC charger 140 or an AC power line at plug 152).

Figure 2:
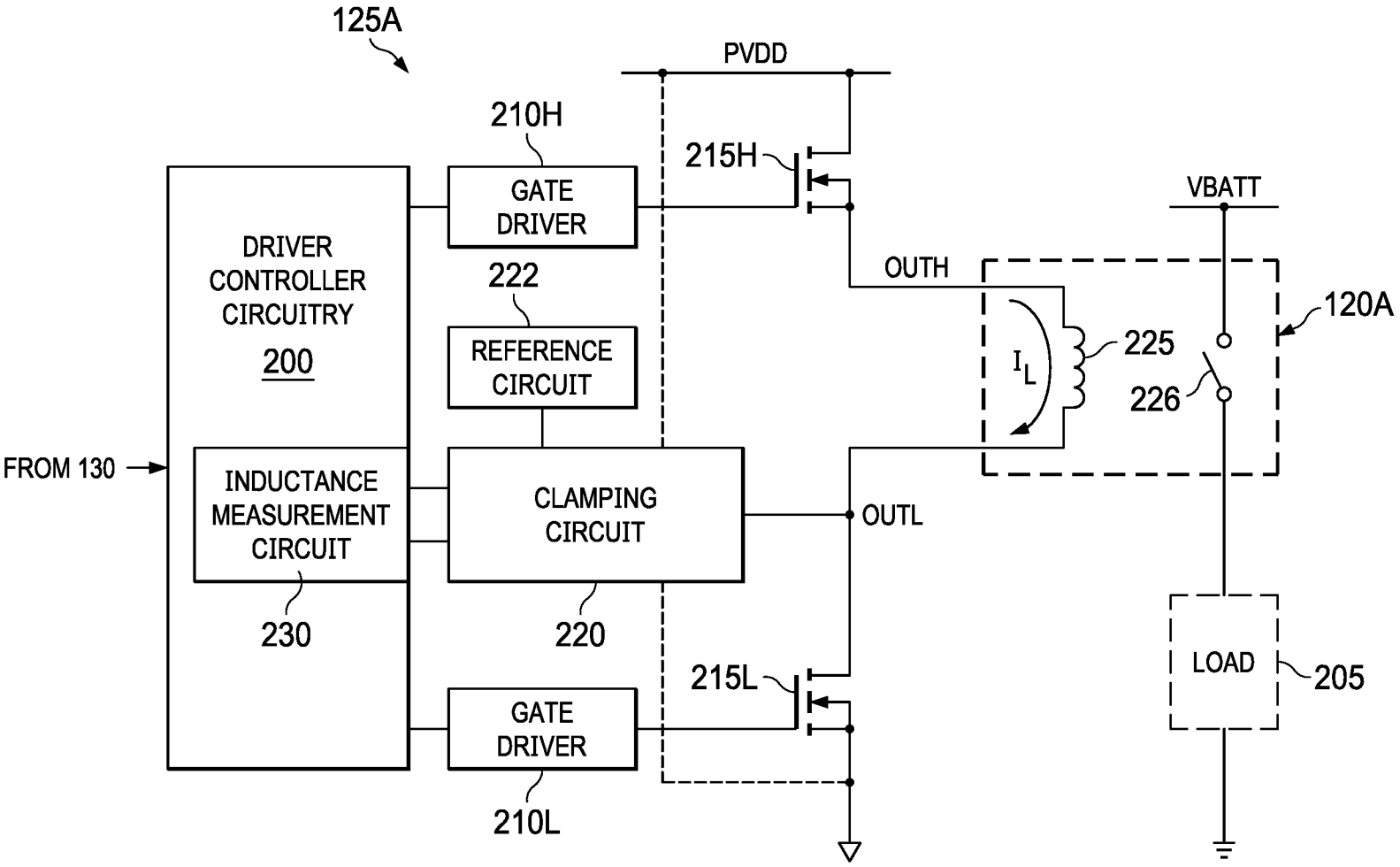
FIG. 2 is an electrical diagram, in block form, of relay driver circuitry for a high power contactor in the architecture of FIG. 1 according to example embodiments.

FIG. 2 illustrates the construction of relay driver 125A in the power system of FIG. 1 by way of example. It is contemplated that relay drivers 125B through 125F, as well as other relay drivers in EV 100 (particularly those controlling relays in the high voltage distribution from battery pack 110), may be similarly constructed according to this example embodiment.

As shown in FIG. 2, relay driver 125A operates to selectively energize or de-energize activation coil 225 in relay 120A which, depending on the configuration, will open or close electrical contact 226 of relay 120A. In the example of relay 120A, the closing of contact 226 will couple battery voltage VBATT to load 205, which in this case represents the load of inverter 112 in powering motor 100 (FIG. 1). Relay driver 125A in this example includes high-side drive transistor 215H with its drain coupled to power supply voltage PVDD and its source at high side node (or terminal) OUTH coupled to one side of coil 225, and low-side drive transistor 215L with its drain coupled to the other side of coil 225 at low side node (or terminal) OUTL and its source coupled to a common potential (e.g., ground). Power supply voltage PVDD may be, for example, a voltage based on battery voltage VBATT, such as a regulated voltage stepped up or stepped down or otherwise derived from battery voltage VBATT. The gates of drive transistors 215H, 215L are driven by respective gate drive circuits 210H, 210L, in response to signals from driver controller circuitry 200. Drive transistors 215H, 215L may be constructed as power field-effect transistors (FETs), and in this example are n-channel devices (nFETs), although either or both of drive transistors 215H, 215L may be realized as p-channel power transistors (pFETs) or other appropriate transistor types. Driver controller circuitry 200 includes digital logic and other circuitry (e.g., analog circuitry, a processor, a state machine or other sequential logic, memory, etc.) for controlling the operation of gate drive circuits 210H, 210L in response to signals from main controller 130 (FIG. 1).

In this example, relay driver 125A is capable of operating in various drive modes, under the control of driver controller circuitry 200. These modes may include a high-side switch mode in which the switching of high-side drive transistor 215H controls the driving of current $I_L$ to coil 225, and conversely a low-side switch mode in which the switching of low-side drive transistor 215L controls the driving of current $I_L$ to coil 225. Clamping circuit 220 is provided in relay driver 125A to limit the voltage at terminals OUTH, OUTL as drive transistors 215H, 215L are turned off, considering that current $I_L$ conducted by coil 225 cannot change instantaneously. For example, the voltage at terminal OUTL can be driven to an extremely high voltage upon the switching off of current to coil 225. In the generalized example of FIG. 2, this voltage is limited by clamping circuit 220, which is coupled to terminal OUTL and to either or both of power supply voltage PVDD or circuit ground.

Reference circuit 222 is a bandgap reference circuit or the like constructed to generate one or more reference current or voltage levels, and provides those reference currents or voltages to clamping circuit 220. In this example embodiment, reference circuit 222 is constructed to provide such reference levels that are stable over variations in manufacturing process, temperature, and power supply voltages (stable over "PVT"). Examples of reference circuits that are reasonable stable over PVT and suitable for use as reference circuit 222 include bandgap reference circuits, self-biased reference circuits, compensated current mirror circuits, and the like.

As noted above, driver controller circuitry 200 includes digital logic and other circuitry for controlling gate drive circuits 210H, 210L to drive the gates of drive transistors 215H, 215L in response to data and control signals from main controller 130 according to the particular operating mode of relay driver 125A and its current conditions. Various additional functionality may also be included in driver controller circuitry 200, including an internal power supply, current limiting circuitry, thermal shutdown circuitry, fault detection and indication circuitry for communicating the status of relay driver 125A to main controller 130, and the like.

In this example embodiment, driver controller circuitry 200 includes inductance measurement circuit 230, which is coupled to clamping circuit 220. As will be described in further detail below, inductance measurement circuit 230 includes logic circuitry configured to measure the inductance of coil 225 of high power relay 120A in an "off-line" state, in the sense that this inductance is measured with relay 120A in a non-actuated state (its "normally open" or "normally closed" condition, as the case may be). In some example embodiments, clamping circuit 220 may include circuitry for sensing/detecting the value of the coil current $I_L$. In some example embodiments, inductance measurement circuit 230 may include a timer and/or be connected to a clocking source.

As mentioned above, the high power circuits used to power EVs such as shown in FIG. 1 commonly operate at relatively high voltages, for example on the order of hundreds of volts, rather than at high currents, to enable the delivery of more power with less loss over a given diameter of copper cable. However, these high voltages present a risk that the contacts of relays 120 can fuse or "weld", which prevents or inhibits the opening of the relay contacts by the magnetic force of the activation coil of the relay. Welded relay contacts may necessitate replacement of the relay in the system. In the case of an electric vehicle, such relay replacement requires servicing of the vehicle at a minimum.

It has been observed that the activation coils of high power contactors, such as high power relays 120, implemented in electric vehicles such as in the architecture of FIG. 1, exhibit a reduced inductance if its relay contacts are welded. For example, a reduction in coil inductance of on the order of 10% to 20% in high power relays with welded contacts has been observed. According to one or more example embodiments, such as described below by way of example, circuitry is provided in relay driver 125 to detect welded relay contacts by measuring the inductance of coil 225 of its associated relay 120 while in an unenergized state (e.g., "off-line"), without requiring additional measurement sensors, relay pins, or additional circuitry.

In the example embodiment of FIG. 2, inductance measurement circuit 230 is provided, for example as part of driver controller circuitry 200 of relay driver 125A, to obtain measurements of the inductance of coil 225 of relay 120A. More specifically, inductance measurement circuit 230 is coupled to clamping circuit 220 by way of which it carries out this inductance measurement. As noted above, clamping circuit 220 in this example embodiment is coupled to terminal OUTL at the low-side end of coil 225, from which the inductance measurements are made.

Figure 3:
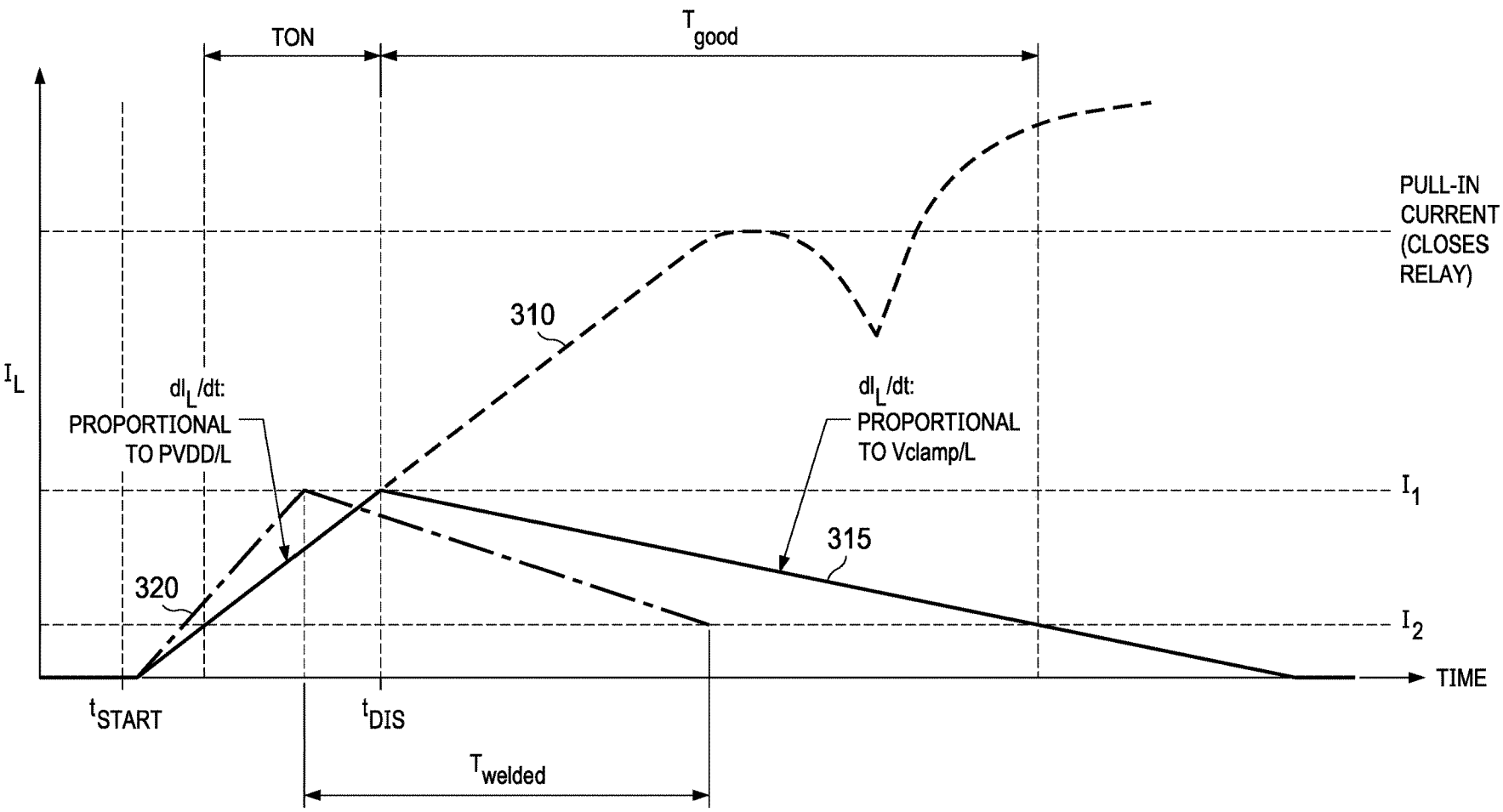
FIG. 3 is a plot of inductor current over time illustrating the measurement of activation coil inductance in a high power contactor according to example embodiments.

To illustrate the theory of operation of the off-line inductance measurement of relay coil 225 according to the example embodiments, FIG. 3 illustrates a plot of coil current $I_L$ in relay 120A over time during a measurement process. According to the timing shown in FIG. 3, relay driver 125A initiates the energizing of coil 225 at time $t_{START}$. Curve 310, which corresponds to an instance of relay 120A with its relay contacts in good condition (i.e., not welded), shows an increase in coil current $I_L$ beginning at a short delay after time $t_{START}$ and then increasing linearly with time, with the rate of increase ($dI_L/dt$) proportional to the ratio of power supply voltage to coil inductance (e.g., PVDD/L). In its normal operation in which coil 225 is driven so as to close the relay contacts of relay 120A, coil current $I_L$ continues to increase along curve 310 until reaching the "pull-in current" level of relay 120A, at which point the contactors are closed. Coil current $I_L$ then exhibits transients due to the change in state of relay 120A as its contactors close, as evident at later times along curve 310.

According to example embodiments, the inductance L of coil 225 of relay 120A is measured at current levels below the pull-in current of relay 120A. FIG. 3 illustrates an example of this inductance measurement. To measure this inductance, relay driver 125A begins charging coil 225 from time $t_{START}$ as in the actuation of relay 120A, such that coil current $I_L$ increases at a rate proportional to PVDD/L as shown by curve 315 during the interval from time $t_{START}$ to time $t_{DIS}$ (overlapping curve 310 for increasing current $I_L$ over that interval). This charging of coil 225 continues until coil current $I_L$ reaches a preselected current level $I_1$, where current $I_1$ is below the pull-in current of relay 120A. For example, the pull-in current of high power relay 120A may be on the order of 2-3 A, while current level $I_1$ may be on the order of 100-150 mA.

Upon coil current $I_L$ reaching current level $I_1$, which occurs at time $t_{DIS}$ in FIG. 3, relay driver 125A turns off the drive to coil 225, such that coil 225 begins discharging through clamping circuit 220. According to the example embodiments, this discharge of coil 225 is a controlled discharge to a specific clamping voltage $V_{CLAMP}$ set by clamping circuit 220. Coil current $I_L$ decreases during this discharge after time $t_{DIS}$, at a rate proportional to the ratio of the clamping voltage to the inductance of coil 225 ($V_{CLAMP}$/L) as shown by curve 315. A timer in inductance measurement circuit 230 is started at time $t_{DIS}$, and measures the time elapsed from the switching of relay driver 125A at time $t_{DIS}$ until coil current $I_L$ reaches a preselected current level $I_2$, where current level $I_2$ is below current level $I_1$. For the case of relay 120A in good condition, this time interval is shown in FIG. 3 as interval $T_{good}$.

For the case of relay 120A with welded contacts, however, the coil inductance of coil 225 will be lower than that in its good condition. This welded contact case is qualitatively illustrated in FIG. 3 by curve 320. Because of the reduction in inductance L of coil 225, the rate of change of coil current $I_L$ during the charging of coil 225 to current level $I_1$ is shorter than that of coil 225 in relay 120A in good condition, and occurs at a time earlier than time $t_{DIS}$ in the good condition case. The discharge time interval $T_{welded}$ of coil 225 from current level $I_1$ to lower current level $I_2$ is also shorter than in a relay 120A in good condition, since the rate of change of coil current $I_L$ is proportional to $V_{CLAMP}$/L, and L is reduced from the good condition case. This difference between discharge time $T_{welded}$ in the welded contact case and discharge time $T_{good}$ in the non-welded contact case provides a mechanism for detecting whether the relay contacts of relay 120A are welded without requiring activation of relay 120A, which could cause malfunction of the end system (EV 100).

One may observe that the charging time, for example between the lower current level $I_2$ and the higher current level $I_1$ in FIG. 3 (shown as time TON for curve 315), is also inversely proportional to the inductance L of activation coil 225 and thus may theoretically be used to detect welded contacts in relay 120A. However, the time rate of change of coil current $I_L$ during this charging phase is proportional to the power supply voltage PVDD, which is not necessarily stable over time as it may vary within a given specification range (e.g., +10%). Accordingly, it may be difficult to distinguish a reduction in inductance over time due to the welding of relay contacts from an increase in power supply voltage over that same time interval. The example embodiments instead use a controlled discharge at a clamping voltage $V_{CLAMP}$, which may be precisely set by clamping device 220, based on a reference voltage or current generated by reference circuit 222 to be stable over variations in manufacturing process parameters, power supply voltage (e.g., PVDD), and operating temperature (PVT).

Figure 4:
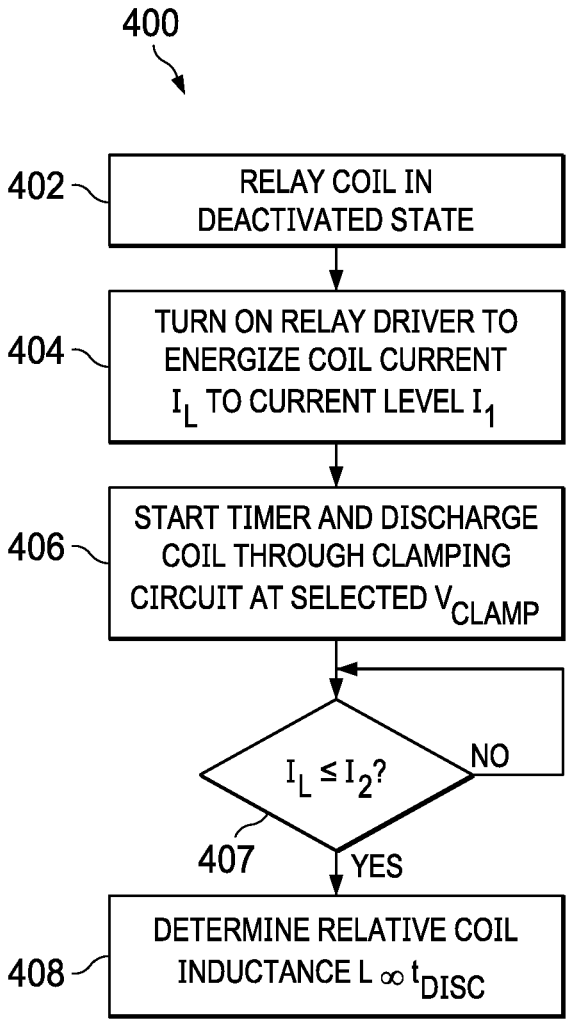
FIG. 4 is a flow diagram illustrating the measurement of activation coil inductance in a high power contactor according to an example embodiment.

Referring now to FIG. 4, a process 400 of measuring inductance of an activation coil, such as activation coil 225 in high power relay 120A, according to example embodiments will now be described. According to these example embodiments, measurement of the activation coil inductance in process 400 is performed "off-line," in the sense that this measurement is obtained at coil current levels substantially below the pull-in current of the corresponding relay. For example, inductance measurement process 400 can be performed at coil currents of on the order of 100-150 mA in relays having pull-in current levels of 2-3 A. Accordingly, inductance measurements according to these example embodiments can be performed periodically and without activating the circuit function (e.g., connection of battery pack 110 to a charging or drive function in EV 100 of FIG. 1) that would be engaged with the relay contactors activated.

This description of process 400 in FIG. 4 will refer to the generalized architecture of FIG. 2 by way of example. In process 402, high power relay 120A is placed into, or is already in, a de-activated state in which relay driver 125A is not providing coil current $I_L$ to activation coil 225. In the example of EV 100 of FIG. 1, this de-activated state may correspond to relay 120A with its contacts open. After coil 225 is in inactive state, relay driver 125A drives a coil current $I_L$ to begin charging coil 225 in process 404. As described above, the driving of coil 225 in process 404 increases coil current $I_L$ until it reaches preselected coil current level $I_1$, which in these example embodiments is substantially below the pull-in current of relay 120A as described above.

Upon coil current $I_L$ reaching current level $I_1$, in process 406 relay driver 125A ceases driving coil 225, thus beginning the discharge phase of the measurement, and a timer is started. This timer may be realized as part of inductance measurement circuit 230, for example as a digital counter configured to count clock pulses or cycles. The discharge of coil 225 in process 406 is controlled through a clamping circuit or device from a selected clamping voltage $V_{CLAMP}$, such that coil current $I_L$ decreases at a rate proportional to the ratio of clamping voltage $V_{CLAMP}$ to the inductance L of coil 225 (i.e., proportional to $V_{CLAMP}$/L).

This discharge phase of coil 225, in which coil current $I_L$ is linearly decreasing, continues so long as coil current $I_L$ remains above a second preselected current level $I_2$ (decision 407 is "no"). Upon coil current $I_L$ reaching the second preselected current level $I_2$ (decision 407 is "yes"), a measure of the inductance L of coil 225 may be determined in process 408. In this example of process 400, this measure of inductance L is determined from a measurement of the time interval from the time at which drive to coil 225 is turned off in response to coil current $I_L$ reaching current level $I_1$ to the time at which coil current $I_L$ has decreased to current level $I_2$. Because the discharge rate of coil current $I_L$ is inversely proportional to the inductance L of coil 225, inductance L is proportional to this discharge time interval, for example as measured by a timer in inductance measurement circuit 230. According to example embodiments, and as will be further described below, this measure of inductance may be determined as a relative inductance, such that changes in the inductance of activation coil 225, and thus the welding of contacts in relay 120A, may be detected. In another example, the relative inductance of activation coil 225 may be expressed simply in terms of the measured time interval (e.g., a number of clock cycles).

Figure 5:
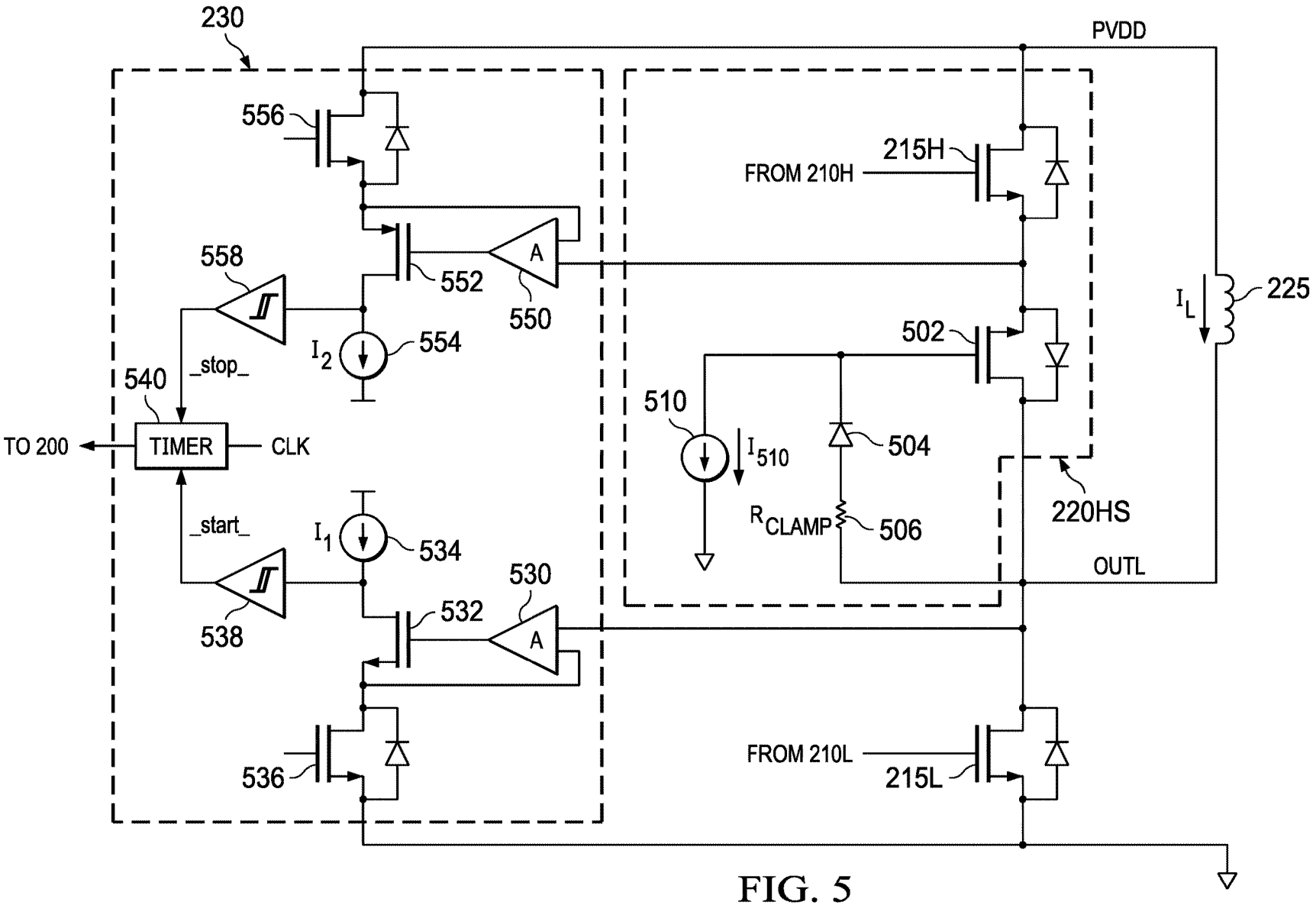
FIG. 5 is an electrical diagram, in schematic and block form, of a low side relay driver by way of which activation coil inductance in a high power contactor may be measured according to an example embodiment.

Referring now to FIG. 5, an implementation of inductance measurement circuit 230 in combination with an instance of relay driver 125A in a low-side drive configuration will be described according to an example embodiment. In this low-side drive configuration, one side of activation coil 225 is coupled to power supply voltage PVDD, while the other side at low side node OUTL is coupled to the drain of n-channel drive transistor 215L. Transistor 215L has its source at circuit ground, and its gate driven from gate drive 210L (FIG. 2). As such, the energizing of activation coil 225, and thus the state of relay 120A, is controlled by low-side drive transistor 215L.

In this low-side drive configuration, clamping device 220HS is implemented on the high-side of relay driver 125A, in that it clamps low side node OUTL relative to power supply voltage PVDD. In this example of FIG. 5, clamping device 220HS includes n-channel transistor 502 connected in series with high-side drive transistor 215H in a back-to-back body diode configuration. More specifically, the drain of transistor 502 is coupled to low side node OUTL and the source of transistor 502 is coupled to the source of drive transistor 215H, which has its drain coupled to power supply voltage PVDD. The gate of transistor 502 is driven from low side node OUTL by the series connection of diode 504 and resistor 506. In this example, the cathode of diode 504 is connected to the gate of transistor 502 and the anode of diode 504 is coupled to low side node OUTL via resistor 506, which has a resistance $R_{CLAMP}$. The gate of transistor 502, and thus the cathode of diode 504, is connected to current source 510, which conducts a current $I_{510}$ to ground as set by a reference level from reference circuit 222 (FIG. 2). The level of current $I_{510}$ sets the clamping voltage $V_{CLAMP}$ to which low side node OUTL is clamped, as will be described below. The gate of drive transistor 215H, as configured in clamping device 220HS in this example implementation, is controlled from gate drive 210H.

In the example embodiment of FIG. 5, inductance measurement circuit 230 includes circuitry configured to sense coil current $I_L$ conducted by activation coil 225 when being charged for comparison with a first preselected current level $I_1$, and circuitry configured to sense coil current $I_L$ conducted by coil 225 during discharge for comparison with a second preselected current level $I_2$. For the comparison of current $I_L$ to the first current level $I_1$, low side node OUTL is coupled to one input of comparator 530. The output of comparator 530 is coupled to the gate of n-channel transistor 532, which has its drain coupled to current source 534 and its source coupled via the source/drain path of n-channel transistor 536 to ground. Current source 534 is controlled by a reference level from reference circuit 222 to conduct current $I_1$. The source of transistor 532, at the drain of transistor 536, is coupled to a second input of comparator 530. The gate of transistor 536 is controlled by a reference voltage from reference circuit 222. The drain of transistor 532 is coupled to an input of Schmitt trigger 538, the output of which is coupled to timer 540.

The portion of inductance measurement circuit 230 configured to sense current $I_L$ for comparison with current $I_2$ as coil 225 discharges includes comparator 550 with an input coupled to the common source node of transistors 502 and 215H. The output of comparator 550 is coupled to the gate of p-channel transistor 552, which has its drain coupled to ground through current source 554. Current source 554 is controlled by a reference level from reference circuit 222 to conduct current $I_2$. The source of transistor 552 is coupled to the source of n-channel transistor 556, which has its drain at power supply voltage PVDD and its gate controlled by a reference voltage from reference circuit 222. The source of transistor 552 is coupled to a second input of comparator 550, and the drain of transistor 552 is coupled to an input of Schmitt trigger 558, the output of which is coupled to timer 540.

In its operation to measure the inductance of activation coil 225 as described above in connection with process 400 of FIG. 4, the implementation of FIG. 5 energizes activation coil 225 (process 404 of FIG. 4) by gate drive 210L turning on low-side transistor 215L. During the charging of coil 225, gate drive 210H biases the gate of drive transistor 215H to operate in the ohmic region. During this charging phase, coil current $I_L$ conducts from power supply voltage PVDD through coil 225 and transistor 215L to circuit ground, at a level increasing toward current level $I_1$. So long as coil current $I_L$ remains below current level $I_1$, comparator 530 presents a high logic level that turns on transistor 532 to conduct current $I_1$ from current source 534 through the series connection of transistor 532 and transistor 536 to ground. Transistor 536 is biased to a condition similar to transistor 215L during this time, for example from reference circuit 222, so that the voltage at the drain of transistor 536 corresponds to the voltage that will appear at low side node OUTL at a coil current $I_L$ equal to current level $I_1$. Those skilled in the art will recognize that the current conducted by current source 534 and transistor 536 may be scaled (e.g., with current source 534 conducting a current lower than current level $I_1$ and transistor 536 scaled accordingly) so that the voltage at the drain of transistor 536 corresponds to the voltage at low side node OUTL and at the drain of transistor 215L when coil current $I_L$ is equal to current level $I_1$. In any case, upon coil current $I_L$ reaching current level $I_1$, comparator 530 changes its output state to turn off transistor 532. In response, the input of Schmitt trigger 538 is driven high from current source 534, causing Schmitt trigger 538 to issue a transition at its output as a signal _start_ to timer 540, indicating that coil current $I_L$ has reached current level $I_1$. In response to signal _start_, timer 540 issues a signal to controller 200 to cause it to control gate drive 210L to turn off transistor 215L and begin the discharge of coil 225 (process 406 of FIG. 4). Also in response to signal _start_, timer 540 begins counting cycles of clock signal CLK, initiating the measurement of the discharge time TOFF of coil 225 from current level $I_1$ to current level $I_2$ as described above relative to FIG. 3 and FIG. 4.

Once transistor 215L is turned off as a result of coil current $I_L$ reaching current level $I_1$, the voltage at low side node OUTL will rapidly increase because current $I_L$ through coil 225 cannot change instantaneously. Clamping device 220HS operates to clamp this voltage. More specifically, a portion of coil current $I_L$ determined by the current 1510 conducted by current source 510 will be conducted through resistor 506 and diode 504. The clamping voltage $V_{CLAMP}$ that develops at low side node OUTL will be set by the voltage drop across resistor 506, namely the product of the resistance $R_{CLAMP}$ of resistor 506 and the current $I_{510}$ conducted by current source 510, plus a diode threshold voltage drop across 504. According to this example embodiment, because current source 510 is biased from reference circuit 222, the current $I_{510}$ conducted by current source 510 can be precisely controlled and stable over PVT, as noted above. Accordingly, clamping voltage $V_{CLAMP}$ to which low side node OUTL is clamped can in turn be precisely and stably set, which controls the discharge of coil 225.

As coil 225 discharges, coil current $I_L$ decreases from current level $I_1$ to which it was charged as shown in FIG. 3, with this decrease at a rate proportional to the ratio of clamping voltage $V_{CLAW}$ to the inductance L of coil 225 (e.g., proportional to $V_{CLAMP}$/L). This coil current $I_L$ is in large part conducted through transistor 502 and transistor 215H of clamping device 220HS, with transistor 215H biased in its ohmic region by gate drive 210H. The voltage at the common source node of transistors 502 and 215H thus differs from power supply voltage PVDD by the voltage drop across transistor 215H, which is proportional to the current through that device. Beginning from the time at which drive transistor 215L is turned off, transistor 552 is turned on by comparator 550, such that current $I_2$ conducted by current source 554 is also conducted through transistor 556, developing a voltage at the source of transistor 552 that corresponds to the voltage that will develop at the common source node of transistors 502 and 215H when coil current $I_L$ is equal to current level 12. Those skilled in the art will recognize that the current conducted by current source 554 and transistor 556 may be scaled (e.g., with current source 554 conducting a current lower than current level $I_2$ and transistor 556 or its bias scaled accordingly) so that the voltage at the source of transistor 552 corresponds to the voltage at low side node OUTL when coil current $I_L$ is equal to current level $I_2$. Upon coil current $I_L$ decreasing to current level 12 as coil 225 discharges (decision 407 of FIG. 4 returns a "yes" result), comparator 550 drives a transition at its output, turning off transistor 552 such that the input of Schmitt trigger 558 is pulled low by current source 554. In response, Schmitt trigger 558 drives a transition at its output as signal _stop_, indicating to timer 540 to stop its counting of pulses of clock CLK. The time required for coil current $I_L$ to discharge from current level $I_1$ to $I_2$ is indicated by the clock CLK cycle count in timer 540. Inductance measurement circuit 230 or other computational logic in controller 200 then determines a measure of inductance of coil 225 from this cycle count (process 408 of FIG. 4).

Figure 6:
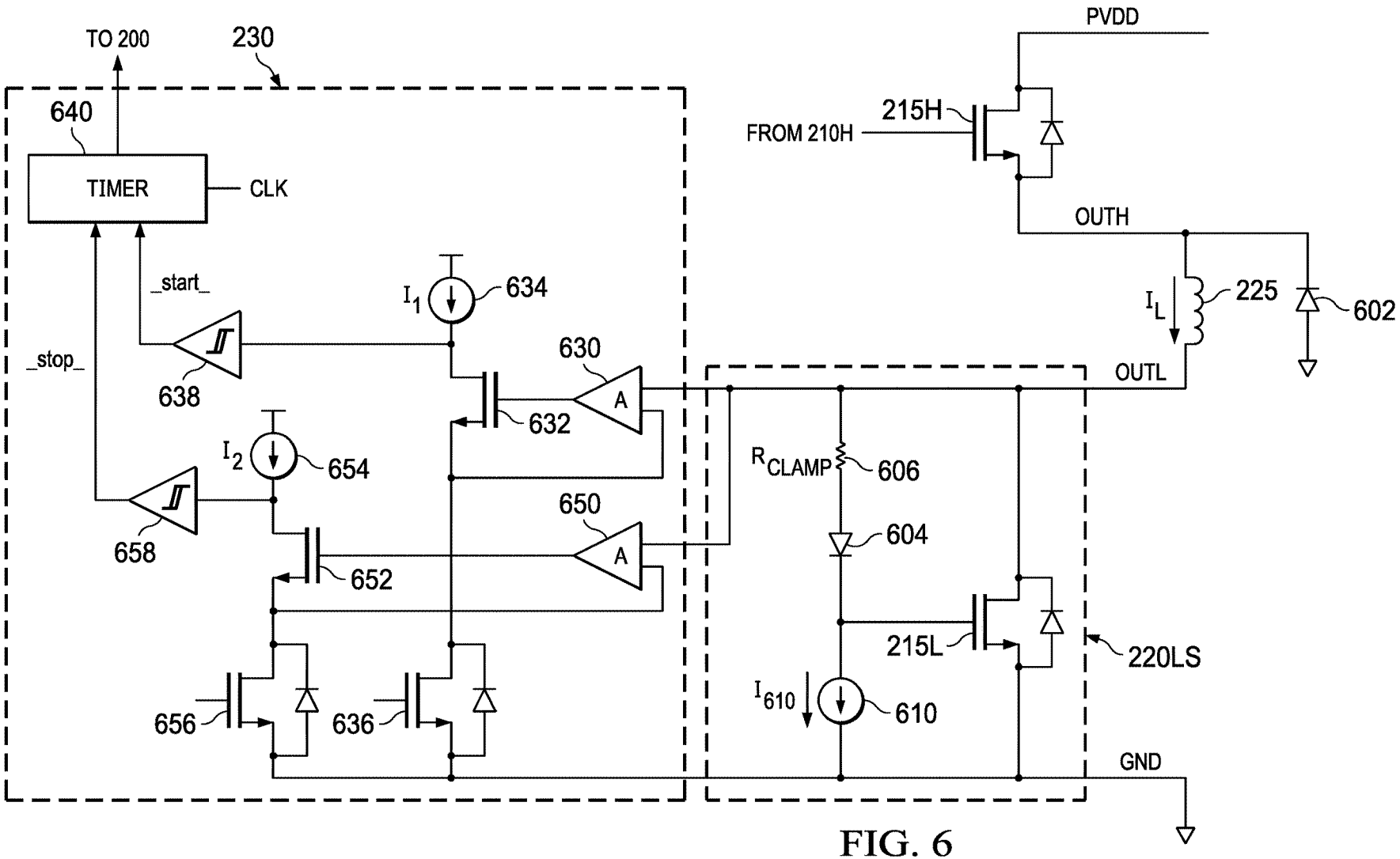
FIG. 6 is an electrical diagram, in schematic and block form, of a high side relay driver by way of which activation coil inductance in a high power contactor may be measured according to another example embodiment.

FIG. 6 illustrates the implementation of inductance measurement circuit with an instance of relay driver 125A in a high-side drive configuration will be described according to another example embodiment. The high-side drive configuration of FIG. 6 may correspond to an alternative implementation from the low-side drive configuration of FIG. 5 as may be fabricated in a different circuit topology; alternatively, it is contemplated that the low-side and high-side drive configurations of FIGS. 5 and 6 may be available in the same integrated circuit, with the particular mode selectable or configurable as desired by the system implementer. In this high-side drive configuration of FIG. 6, the "high" side of activation coil 225 at high side node OUTH is coupled to the source of high-side drive transistor 215H, which has its drain at power supply voltage PVDD, while the "low" side of coil 225 at low side node OUTL is coupled to the drain of n-channel drive transistor 215L, which has its source at circuit ground. The gate of high-side transistor 215H is driven from gate drive 210H (FIG. 2), and operates to energize activation coil 225 in normal operation to actuate relay 120A.

In this example embodiment, low-side clamping of low side node OUTL is provided by clamping device 220LS, which is realized by low-side drive transistor 215L in combination with the circuitry that sets its gate bias. In this example, the gate bias of transistor 215L is established by resistor 606 coupled on one side to low side node OUTL and on the other side to the anode of diode 604, which has its cathode connected to the gate of transistor 215L. Current source 610 is connected between the gate of transistor 215L and circuit ground, and is controlled by a reference level generated by reference circuit 222 to conduct a stable current $I_{610}$. Current $I_{610}$ is controlled to set a desired clamping voltage $V_{CLAMP}$ at terminal OUTL, biasing transistor 215L into its ohmic region.

Diode 602 has its cathode connected to terminal OUTH and its anode at circuit ground, to clamp the voltage at terminal OUTH as transistor 215H is turned off.

In its operation to measure the inductance of activation coil 225 according to process 400 of FIG. 4, the charging of activation coil 225 (process 404 of FIG. 4) begins with gate drive 210H turning on drive transistor 215H such that coil current $I_L$ conducts from power supply voltage PVDD through coil 225 to ground through drive transistor 215L, which is biased into its ohmic region through the action of current source 610, resistor 606, and diode 604. In this example embodiment, inductance measurement circuit 230 includes circuitry configured to sense coil current $I_L$ conducted by activation coil 225 when being charged for comparison with a first preselected current level $I_1$, and circuitry configured to sense coil current $I_L$ conducted by coil 225 during discharge for comparison with a second preselected current level $I_2$. As coil 225 is energized, coil current $I_L$ linearly increases at a rate of change proportional to PVDD/L as described above in connection with FIG. 3. With drive transistor 215L self-biased in its ohmic region, a voltage develops at low side node OUTL, at the drain of transistor 215L, that is proportional to coil current $I_L$, and thus operates to sense coil current $I_L$. This voltage at low side node OUTL is applied to an input of comparator 630, which compares that voltage with the voltage at the source of transistor 632 as current $I_1$ is conducted from current source 634 through transistor 632 and transistor 636. Transistor 636 is biased from reference circuit 222 into its ohmic region, similarly as drive transistor 215L, so that the comparison made by comparator 630 corresponds to a comparison of coil current $I_L$ with current $I_1$ from current source 634. Those skilled in the art will recognize that the current conducted by current source 634 and transistor 636 may be scaled (e.g., with current source 634 conducting a current lower than current level $I_1$ and transistor 636 scaled accordingly) so that the voltage at the drain of transistor 636 corresponds to the voltage at low side node OUTL and at the drain of transistor 215L when coil current $I_L$ is equal to current level $I_1$. Upon coil current $I_L$ increasing to current level $I_1$, comparator 630 drives a transition at its output that turns off transistor 632. The input of Schmitt trigger 638 is driven high from current source 634, causing Schmitt trigger 638 to issue a transition at its output as signal _start_, indicating to timer 640 that coil current $I_L$ has reached current level $I_1$. In response, timer 640 issues a signal to controller 200 to cause it to control gate drive 210H to turn off transistor 215H, which initiates the discharge of coil 225 (process 406 of FIG. 4). Also in response to signal _start_, timer 640 begins counting cycles of clock signal CLK to measure the time required for coil current $I_L$ to decrease from current level $I_1$ to current level $I_2$, as described above relative to FIG. 3.

In the high-side drive implementation of FIG. 6, the turning off of drive transistor 215H causes voltage transients at nodes OUTH and OUTL, since the current conducted by coil 225 cannot change instantaneously. High side node OUTH is pulled to a low voltage, which is clamped by diode 602 to a threshold voltage below circuit ground. Low side node OUTL is clamped to a positive voltage $V_{CLAMP}$ established by clamping device 220LS. In the implementation of FIG. 6, voltage $V_{CLAMP}$ is determined by current 1610 conducted by current source 610, which is set by a reference voltage or current from reference circuit 222. More specifically, the clamping voltage $V_{CLAMP}$ depends on the voltage drop across resistor 606 (having a resistance $R_{CLAMP}$), the diode threshold voltage drop across diode 604, and the voltage drop across current source 610. Because the current 1610 controlled by reference circuit 222 can be very stable over PVT, the voltage $V_{CLAMP}$ is similarly stable.

As the discharge phase of the inductance measurement begins, coil current $I_L$ begins to fall from current level $I_1$ as described above in connection with FIG. 3, with this decrease at a rate proportional to the ratio of clamping voltage $V_{CLAMP}$ to the inductance L of coil 225 (i.e., proportional to $V_{CLAMP}/L$). During this discharge phase, the voltage at low side node OUTL and at an input of comparator 650 corresponds to coil current $I_L$. So long as coil current $I_L$ is higher than the current $I_2$ conducted by current source 654 (decision 407 is "no"), comparator 652 maintains transistor 652 in an "on" (conducting) state and thereby conducting current $I_2$ from current source 654 to ground. The voltage that develops at the drain of transistor 652 corresponds to the voltage that will develop at low side node OUTL when coil current $I_L$ is equal to current level 12. Those skilled in the art will recognize that the current conducted by current source 654 and transistor 656 may be scaled (e.g., with current source 654 conducting a current lower than current level $I_2$ and transistor 656 or its bias scaled accordingly) so that the voltage at the source of transistor 652 corresponds to the voltage at low side node OUTL when coil current $I_L$ is equal to current level 12. Upon coil current $I_L$ decreasing to current level $I_2$ as coil 225 discharges (decision 407 is "yes"), comparator 650 drives a transition at its output that turns off transistor 652, causing Schmitt trigger 658 to drive a transition at its output, shown as signal _stop_ in FIG. 6. In response to signal _stop_, timer 640 stops counting of pulses of clock CLK. The number of cycles of clock CLK between signal _start_ and signal _stop_, as counted by timer 640, indicates the time required for coil current $I_L$ to discharge from current level $I_1$ to $I_2$, which can be used to determine the inductance of coil 225 (process 408 of FIG. 4).

Figure 7:
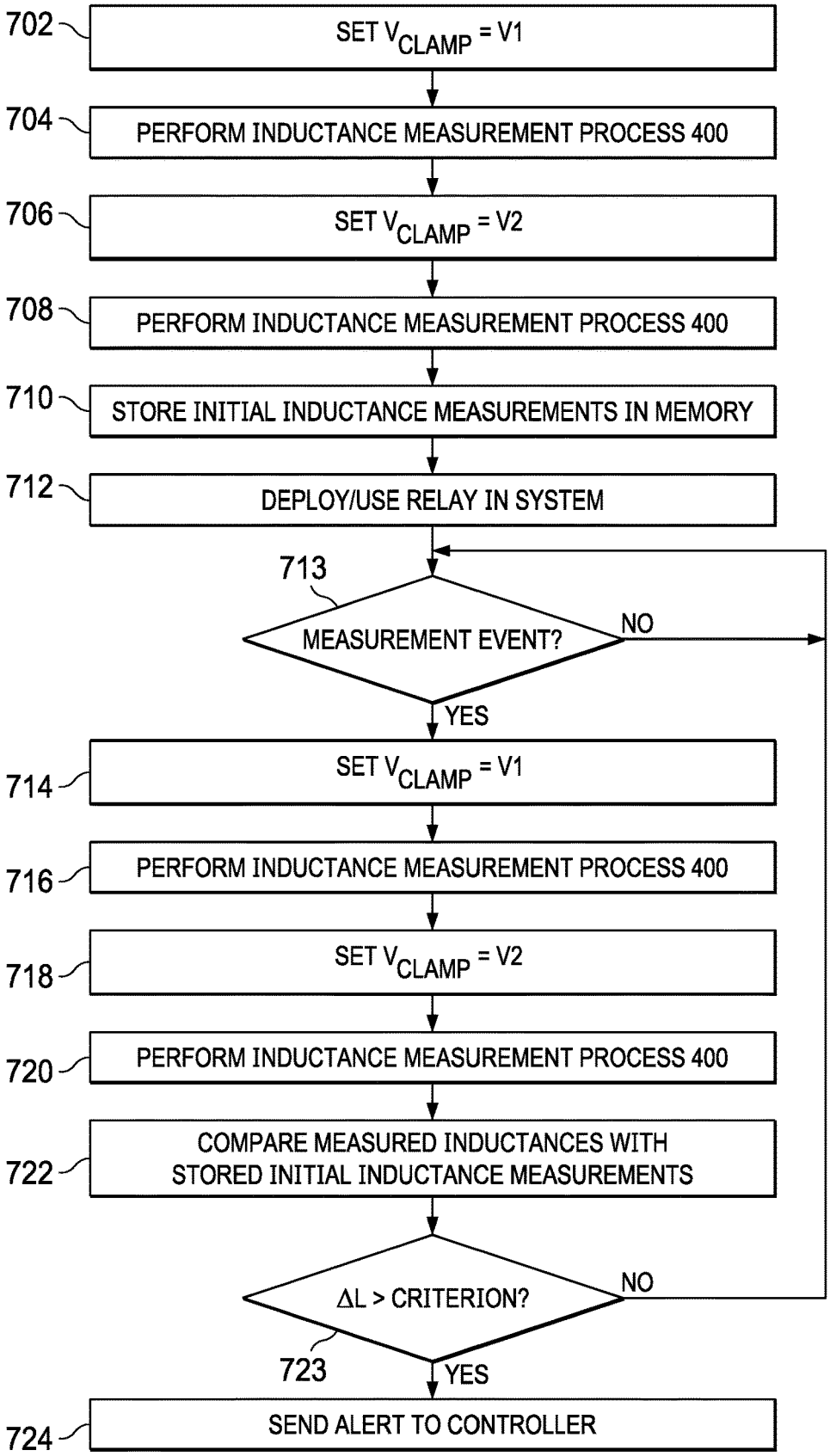
FIG. 7 is a flow diagram illustrating a method of detecting welded contacts in a high power contactor according to an example embodiment.

Referring now to FIG. 7, a method of detecting welded contacts in a high power relay such as relays 120 in EV 100 according to example embodiments will now be described. In the method of FIG. 7, this detection of welded contacts is based on a comparison of inductance measurements over time, for example beginning with initial deployment or early life of the relay in its end system (e.g., EV 100) and continuing over its operating life. Accordingly, the inductance measured by process 400 is not necessarily an absolute measurement of activation coil inductance, but rather can be a baseline measurement against which relative changes in the inductance over time can be compared.

Accordingly, the method of FIG. 7 according to example embodiments performs an initial measurement of activation coil inductance, for example at the time of initial deployment of relay 120 in its end system. For purposes of this description, the method of FIG. 7 will be described relative to one such relay 120A. In systems such as EV 100 in which multiple high power relays 120 are implemented, the method of FIG. 7 will of course be performed for each relay 120 of interest. For example, the method of FIG. 7 may be performed for each relay 120A through 120F that operates to switch high voltages and is thus vulnerable to the welding of its contacts.

As described above in connection with FIG. 4, relative inductance measurements according to example embodiments may be performed over time using a single clamping voltage $V_{CLAMP}$ from which the discharge time of activation coil 225, specifically the time required for coil current $I_L$ to fall from a selected first current level $I_1$ to a selected lower current level $I_2$, is measured. As noted above, the time rate of change of coil current $I_L$ in this discharge phase is proportional to the ratio of the clamping voltage $V_{CLAMP}$ to the inductance L of coil 225 ($V_{CLAMP}$/L). Use of a single clamping voltage for measuring and comparing measured inductance over time may be suitable in some applications. However, for some high power relays 120, particularly those for which welded contacts may cause a catastrophic failure of the end system, may call for additional measurement accuracy and reliability for the detection of welded contacts. For those situations, the measurement and comparison of coil inductance may be performed at multiple clamping voltages. The method illustrated in the flow diagram of FIG. 7 utilizes measurement at two clamping voltages, as will now be described.

To commence an initial inductance measurement, a first clamping voltage $V_{CLAMP}$=V1 is selected and set by inductance measurement circuit 230, for example under the direction of controller 130 in response to program instructions or user input. In these example embodiments, the operation of the method of FIG. 7 is executed and controlled by controller 200 in relay driver 125A for the relay 120A being tested, either 130 operates individually or in combination with controller 200 in each As described above in connection with the implementation examples of FIG. 5 and FIG. 6, the clamping voltage $V_{CLAMP}$ can be precisely controlled according to the currents $I_{510}$ and $I_{610}$ set by current sources 510 and 610, respectively, under the control of reference circuit 222. Accordingly, clamping voltage $V_{CLAMP}$ to voltage V1 is set by a reference voltage or current level generated by reference circuit 222. In process 704, a first initial inductance measurement of activation coil 225 in relay 120A is performed according to process 400 described above, in which the discharge time measurement (process 406 of FIG. 4) is performed using the first clamping voltage $V_{CLAMP}$=V1. Accordingly, the time rate of change of coil current $I_L$ in process 704 will be proportional to the ratio V1/L.

In process 706, a second clamping voltage $V_{CLAMP}$=V2 is set by reference circuit 222 setting the current $I_{510}$ or $I_{610}$ conducted by current source 510 or 610, respectively. In process 708, inductance measurement process 400 is then performed at the second clamping voltage $V_{CLAMP}$=V2 to obtain an inductance measurement at a time rate of change of coil current $I_L$ that is proportional to the ratio V2/L. As noted above relative to process 400 of FIG. 4, the inductance measurement obtained in processes 704, 708 may be relative inductance measurements, rather than an absolute measure of inductance, in that the detection of welded contacts according to example embodiments is based on a comparison of measured inductance over time. As such, the inductance measurements obtained in processes 704, 708 may be expressed in any number of ways, including as simply the measured discharge time (e.g., in the form of a number of clock cycles), or as a calculated relative inductance such as a ratio of clamping voltage $V_{CLAMP}$ to the measured discharge time to normalize the measurements with clamping voltage.

In process 710, the two initial inductance measurements obtained at the two clamping voltages V1, V2 in processes 704, 708, respectively, are stored in memory, such as memory in controller 200. These initial inductance measurements are stored in association with a timestamp or other indication that the measurements are the initial or baseline inductance measurements for coil 225 in relay 120A at the two clamping voltages V1, V2.

Relay 120A is then deployed or operated in use in EV 100, or other end system, in process 712. In this operation in process 712, relay 120A may be actuated to open and close its contacts multiple times. For purposes of welded contact detection according to this example embodiment, this actuation and use in process 712 continues until a measurement event occurs (decision 713 returns a "yes" result). This measurement event may be the elapse of a time period, for example a system operation or "on" time interval, a selected number of actuations of relay 120A, or an event in the operation of EV 100, such as the odometer reaching a certain mileage, servicing of the vehicle, or detection of a system error or fault by on-board test or computer resources.

Upon the occurrence of a measurement event, the inductance of activation coil 225 in relay 120A is again performed at both clamping voltages V1 and V2 in this example. Relay 120A may be the only relay measured in EV 100, for example if the measurement event stems from a fault related to relay 120A, or alternatively all relays 120A through 120F in EV 100 may be measured, for example if the measurement event is based on the elapse of a time interval or is a dealer service visit. This measurement process proceeds in much the same manner as the initial inductance measurement of processes 702 to 708, beginning with the setting of clamping voltage $V_{CLAMP}$ to the first clamping voltage $V_{CLAMP}$=V1 in process 714.

In process 716, a first inductance measurement of activation coil 225 in relay 120A is performed according to process 400 described above, using the first clamping voltage $V_{CLAMP}$=V1 in the discharge of coil 225 and measurement of the time of discharge from current level $I_1$ to current level $I_2$. As described above in connection with process 406 of FIG. 4, the inductance measurement of process 716 is performed "off-line" with activation coil 225 in an unenergized state (e.g., with relay 120A not actuated). As before, the time rate of change of coil current $I_L$ in process 714 will be proportional to the ratio V1/L. Because clamping voltage $V_{CLAMP}$ is the same in process 716 as in initial process 706, a difference in the discharge time from that measured in process 704 will indicate a change in the inductance L of coil 225.

In process 718, clamping voltage $V_{CLAMP}$ is set to the second clamping voltage $V_{CLAMP}$=V2, as set in process 706 for the initial measurement. Inductance measurement process 400 is then performed again at this second clamping voltage V2, in process 720, such that the time rate of change of coil current $I_L$ in its discharge is proportional to the ratio V1/L.

After the completion of inductance measurement processes 716, 720 at the two clamping voltages V1, V2, the measured inductances so obtained after operation (e.g., in response to the measurement event of decision 713) are compared in process 722 with the initial inductance measurements for coil 225 as obtained in processes 704, 708 and stored in memory in process 710. This comparison of process 722 may be performed as a comparison of the most current measured inductances at each of the clamping voltages with the corresponding initial measurements, a comparison of an average of the current inductances at the two clamping voltages with an average of the initial measurements, computation of a variance or deviation statistic, or the like.

In decision 723, inductance measurement circuitry 230 determines whether a change in the inductance of activation coil 225 (as detected in comparison process 722) exceeds a comparison criteria. Various comparison criteria may be used to determine whether a significant change in the measured inductance (e.g., a reduction due to welded contacts) has occurred. For example, a comparison criterion for decision 723 may be a difference of more than 10% from the initial measured inductance, as measured at both clamping voltages V1, V2. Alternatively, the comparison criterion used in decision 723 may be a difference of more than a certain percentage in an average of the inductances measured at both clamping voltages V1, V2. Further in the alternative, for example after a certain number of inductance measurements are obtained over time, the comparison criterion applied in decision 723 may be based on whether the most recent inductance measurements are outside of a statistical measure over all inductance measurements obtained for relay 120A, or alternatively a number of recent measurements. If the comparison criterion has not been exceeded (decision 723 is "no"), operation of relay 120A in EV 100 continues, awaiting a next measurement event as detected in decision 713. If, however, decision 723 determines that the inductance of activation coil 225 has changed by an amount exceeding the comparison criterion (decision 723 is "yes"), an alert is issued, for example by inductance measurement circuit 230 to controller 130 in process 724, to indicate the possibility of welded contacts in relay 120A. In response to this welded contact alert, controller 130 or other control circuitry in the system can then take the appropriate action, such actions including issuing of an alarm to the driver or user, shutting down certain functions in EV 100, and the like.

The example embodiments described above enable accurate and reliable detection of welded contacts in high power relays based on "off-line" measurements of activation coil inductance. Accuracy in the inductance measurements can be obtained by using the measurement of coil discharge time, from current levels well below the pull-in current of the relay, and in a way that is completely agnostic to the power supply voltage currently in the system. Further accuracy and reliability can be attained through the use of a controlled dual clamp level with a differential measurement of discharge time between the two clamping measurements, which significantly improves measurement accuracy.

As used herein, the terms "terminal", "node", "interconnection" and "pin" are used interchangeably. Unless specifically stated to the contrary, these terms are generally used to mean an interconnection between or a terminus of a device element, a circuit element, an integrated circuit, a device, or other electronics or semiconductor component.

Unless otherwise stated, "about," "approximately," or "substantially" preceding a value means +/−10 percent of the stated value. Modifications are possible in the described examples, and other examples are possible within the scope of the claims.

A device that is "configured to" perform a task or function may be configured (e.g., programmed and/or hardwired) at a time of manufacturing by a manufacturer to perform the function and/or may be configurable (or re-configurable) by a user after manufacturing to perform the function and/or other additional or alternative functions. The configuring may be through firmware and/or software programming of the device, through a construction and/or layout of hardware components and interconnections of the device, or a combination thereof.

A circuit or device that is described herein as including certain components may instead be adapted to be coupled to those components to form the described circuitry or device. For example, a structure described as including one or more semiconductor elements (such as transistors), one or more passive elements (such as resistors, capacitors, and/or inductors), and/or one or more sources (such as voltage and/or current sources) may instead include only the semiconductor elements within a single physical device (e.g., a semiconductor die and/or integrated circuit (IC) package) and may be adapted to be coupled to at least some of the passive elements and/or the sources to form the described structure either at a time of manufacture or after a time of manufacture, for example, by an end-user and/or a third-party.

Circuits described herein are reconfigurable to include the replaced components to provide functionality at least partially similar to functionality available prior to the component replacement. Components shown as resistors, unless otherwise stated, are generally representative of any one or more elements coupled in series and/or parallel to provide an amount of impedance represented by the shown resistor. For example, a resistor or capacitor shown and described herein as a single component may instead be multiple resistors or capacitors, respectively, coupled in parallel between the same nodes. For example, a resistor or capacitor shown and described herein as a single component may instead be multiple resistors or capacitors, respectively, coupled in series between the same two nodes as the single resistor or capacitor.

While the use of particular transistors are described herein, other transistors (or equivalent devices) may be used instead with little or no change to the remaining circuitry. For example, a metal-oxide-silicon FET ("MOSFET") (such as an n-channel MOSFET, nMOSFET, or a p-channel MOSFET, pMOSFET), a bipolar junction transistor (BJT—e.g. NPN or PNP), insulated gate bipolar transistors (IGBTs), and/or junction field effect transistor (JFET) may be used in place of or in conjunction with the devices disclosed herein. The transistors may be depletion mode devices, drain-extended devices, enhancement mode devices, natural transistors or other type of device structure transistors. Furthermore, the devices may be implemented in/over a silicon substrate (Si), a silicon carbide substrate (SiC), a gallium nitride substrate (GaN) or a gallium arsenide substrate (GaAs).

While certain elements of the described examples are included in an integrated circuit and other elements are external to the integrated circuit, in other example embodiments, additional or fewer features may be incorporated into the integrated circuit. In addition, some or all of the features illustrated as being external to the integrated circuit may be included in the integrated circuit and/or some features illustrated as being internal to the integrated circuit may be incorporated outside of the integrated. As used herein, the term "integrated circuit" means one or more circuits that are: (i) incorporated in/over a semiconductor substrate; (ii) incorporated in a single semiconductor package; (iii) incorporated into the same module; and/or (iv) incorporated in/on the same printed circuit board Uses of the phrase "ground" in the foregoing description include a chassis ground, an Earth ground, a floating ground, a virtual ground, a digital ground, a common ground, and/or any other form of ground connection applicable to, or suitable for, the teachings of this description.

While one or more embodiments have been described in this specification, it is of course contemplated that modifications of, and alternatives to, these embodiments, such modifications and alternatives capable of obtaining one or more of the technical effects of these embodiments, will be apparent to those of ordinary skill in the art having reference to this specification and its drawings. It is contemplated that such modifications and alternatives are within the scope of the claims presented herein.

What is claimed is:

1. A method of detecting a contact failure in a relay actuated by an activation coil, the method comprising the steps of:

at a first time:

conducting a coil current through the activation coil, the coil current increasing to a first current level less than a pull-in current of the relay;

responsive to the coil current reaching the first current level, discharging the coil current at a first clamping voltage; and determining a first discharge time to the coil current reaching a second current level, the second current level being less than the first current level;

at a second time:

conducting a coil current through the activation coil, the coil current increasing to the first current level;

responsive to the coil current reaching the first current level, discharging the coil current at the first clamping voltage; and determining a second discharge time to the coil current reaching the second current level;

comparing a first inductance corresponding to the first discharge time to a second inductance corresponding to the second discharge time to determine whether a difference between the first and second inductances exceeds a comparison criterion.

2. The method of claim 1, further comprising:

responsive to the difference between the first and second inductances exceeding the comparison criterion, issuing an alert indicating a contact failure of the relay.

3. The method of claim 1, further comprising:

at the first time:

conducting a coil current through the activation coil, the coil current increasing to the first current level;

responsive to the coil current reaching the first current level, discharging the coil current at a second selected clamping voltage; and determining a third discharge time to the coil current reaching the second current level; and at the second time:

conducting a coil current through the activation coil, the coil current increasing to the first current level;

responsive to the coil current reaching the first current level, discharging the coil current at the second selected clamping voltage; and measuring a fourth discharge time to the coil current reaching the second current level;

and wherein the comparing step comprises:

comparing the first inductance and a third inductance corresponding to the third discharge time to the second inductance and a fourth inductance corresponding to the fourth discharge time, to determine whether one or more differences between the first and third inductances and the second fourth inductances exceeds the comparison criterion.

4. The method of claim 3, wherein the comparing step comprises:

comparing the first inductance to the third inductance;

comparing the second inductance to the fourth inductance;

determining whether at least one of the difference between the first and third inductances and the difference between the second and fourth inductances exceeds the comparison criterion.

5. The method of claim 1, wherein the conducting steps each comprise applying a drive to the activation coil;

wherein the discharging steps each comprise turning off the drive to the activation coil;

and wherein the steps of determining the first and second discharge times each comprise determining a discharge time from the turning off of the drive to the activation coil to the coil current reaching the first and second current levels, respectively.

6. The method of claim 5, wherein the activation coil has a high side coupled to a power supply voltage and has a low side at a low side node;

wherein the steps of applying a drive to the activation coil comprise:

turning on a low-side drive transistor having a conduction path coupled between the low side node and circuit ground;

sensing the coil current at the low side node; and comparing the sensed coil current with a current corresponding to the first current level;

wherein the turning off steps comprise:

turning off the low-side drive transistor responsive to the sensed coil current reaching the first current level.

7. The method of claim 6, wherein the discharging step at the first time comprises:

biasing a clamping device to clamp the low side node to the first clamping voltage and to conduct coil current through the clamping device;

sensing the coil current conducted through the clamping device;

comparing the sensed coil current with a current corresponding to the second current level;

wherein the determining step comprises:

starting a timer responsive to the sensed coil current at the low side node reaching the first current level; and stopping the timer responsive to the sensed coil current conducted through the clamping device reaching the second current level.

8. The method of claim 7, wherein the discharging step at the second time comprises:

biasing the clamping device to clamp the low side node to the second clamping voltage and to conduct coil current through the clamping device;

sensing the coil current conducted through the clamping device;

comparing the sensed coil current with a current corresponding to the second current level;

wherein the discharging step comprises:

starting a timer responsive to the sensed coil current at the low side node reaching the first current level; and stopping the timer responsive to the sensed coil current conducted through the clamping device reaching the second current level.

9. The method of claim 8, further comprising:

establishing the first and second clamping voltages by controlling a current source at the control terminal of the clamping device to conduct a first current and a second current, respectively.

10. The method of claim 5, wherein the activation coil has a high side at a high side node, and has a low side at a low side node;

wherein the steps of applying a drive to the activation coil comprise:

turning on a high-side drive transistor having a conduction path coupled between the high side node and a power supply voltage;

biasing a low side drive transistor into the ohmic region, the low side drive transistor having a conduction path coupled between the low side node and circuit ground;

sensing the coil current at the low side node; and comparing the sensed coil current with a current corresponding to the first current level;

and wherein the turning off steps comprise:

turning off the high-side drive transistor responsive to the sensed coil current reaching the first current level.

11. The method of claim 10, wherein the discharging step at the first time comprises:

biasing a clamping device to clamp the low side node to the first clamping voltage and to conduct coil current through the clamping device;

sensing the coil current conducted through the clamping device;

comparing the sensed coil current with a current corresponding to the second current level;

wherein the discharging step comprises:

starting a timer responsive to the sensed coil current at the low side node reaching the first current level; and stopping the timer responsive to the sensed coil current conducted through the clamping device reaching the second current level.

12. The method of claim 11, wherein the discharging step at the second point in time comprises:

biasing the clamping device to clamp the low side node to the second clamping voltage and to conduct coil current through the clamping device;

sensing the coil current conducted through the clamping device;

comparing the sensed coil current with a current corresponding to the second current level;

wherein the determining step comprises:

starting a timer responsive to the sensed coil current at the low side node reaching the first current level; and stopping the timer responsive to the sensed coil current conducted through the clamping device reaching the second current level.

13. The method of claim 12, further comprising:

establishing the first and second clamping voltages by controlling a current source at the control terminal of the clamping device to conduct a first current and a second current, respectively.

14. A relay driver, comprising:

a high side terminal adapted to be coupled to a first terminal of an activation coil of a relay;

a low side terminal adapted to be coupled to a second terminal of the activation coil;

one or more drive transistors configured to apply a drive signal at one or more of a high side terminal and a low side terminal;

a clamping device, coupled to the low side terminal and to one or more of a power supply voltage and a circuit ground, and configured to clamp the low side terminal to a selected clamping voltage;

an inductance measurement circuit coupled to the clamping device and comprising:

a first comparator configured to compare a coil current conducted from the low side terminal with a first current level while the one or more drive transistors are applying the drive signal, and to issue a start signal responsive to the coil current increasing to the first current level, the first current level selected to be less than a pull-in current of the relay;

a second comparator configured to compare the coil current conducted from the low side terminal with a second current level while the one or more drive transistors are not applying the drive signal, and to issue a stop signal responsive to the coil current decreasing to the second current level from the first current level; and a timer for measuring a time elapsed between the start signal and the stop signal, and having an output; and control circuitry configured to control the one or more drive transistors to stop applying the drive responsive to the start signal.

15. The relay driver of claim 14, further comprising:

a reference circuit configured to generate a reference level;

and wherein the selected clamping level corresponds to the reference level generated by the reference circuit.

16. The relay driver of claim 15, wherein the one or more drive transistors comprise:

a low side drive transistor having a conduction path coupled between the low side terminal and circuit ground;

wherein the clamping device comprises:

a clamping transistor having a conduction path coupled between the low side terminal and the power supply voltage;

clamping bias circuitry coupled between the low side terminal and a control terminal of the clamping transistor, and comprising a current source conducting a current corresponding to the reference level;

wherein the first comparator has a first input coupled to the low side terminal, a second input coupled to receive a voltage corresponding to the first current level, and an output coupled to the timer;

and wherein the second comparator has a first input coupled to one side of the conduction path of the clamping transistor, a second input coupled to receive a voltage corresponding to the second current level, and an output coupled to the timer.

17. The relay driver of claim 16, wherein the clamping transistor is a field effect transistor;

wherein the clamping bias circuitry further comprises:

a resistor; and a diode, coupled in series with the resistor between the low side terminal and the control terminal of the clamping transistor;

and wherein the current source of the clamping bias circuitry is coupled between the control terminal of the clamping transistor and circuit ground.

18. The relay driver of claim 15, wherein the one or more drive transistors comprise:

a high side drive transistor having a conduction path coupled between the high side terminal and a power supply voltage;

wherein the clamping device comprises:

a clamping transistor having a conduction path coupled between the low side terminal and circuit ground;

clamping bias circuitry coupled between the low side terminal and a control terminal of the clamping transistor, and comprising a current source conducting a current corresponding to the reference level;

wherein the first comparator has a first input coupled to the low side terminal, a second input coupled to receive a voltage corresponding to the first current level, and an output coupled to the timer;

and wherein the second comparator has a first input coupled to the low side terminal, a second input coupled to receive a voltage corresponding to the second current level, and an output coupled to the timer.

19. The relay driver of claim 18, wherein the clamping transistor is a field effect transistor;

wherein the clamping bias circuitry further comprises:

a resistor; and a diode, coupled in series with the resistor between the low side terminal and the control terminal of the clamping transistor;

and wherein the current source of the clamping bias circuitry is coupled between the control terminal of the clamping transistor and circuit ground.

20. A method of detecting a contact failure in a relay actuated by an activation coil, the method comprising:

providing a coil current through the activation coil, the current increasing to a first current level that is less than a pull-in current of the relay;

stopping the coil current through the activation coil after reaching the first current level;

discharging energy stored by the activation coil;

determining a time to discharge the energy stored by the activation coil;

based on a time to discharge the energy stored by the activation coil, determining an inductance of the activation coil; and indicating the relay has the contact failure when the inductance of the activation coil is different from an inductance of a relay that does not have a contact failure.

21. The relay driver of claim 20 wherein the inductance of the activation coil is different by five percent or more from an inductance of a relay that does not have a contact failure.

22. The relay driver of claim 20 wherein the inductance of the activation coil is different by ten percent or more from an inductance of a relay that does not have a contact failure.

23. The method of claim 20, wherein the activation coil has a high side coupled to a power supply voltage and has a low side at a low side terminal.

24. The method of claim 23, wherein the step of providing a coil current to the activation coil comprises:

turning on a low-side drive transistor having a conduction path coupled between the low side terminal and circuit ground.

25. The method of claim 24, wherein the step of stopping the coil current comprises:

turning off the low-side drive transistor when the coil current reaches the first current level.

26. The method of claim 25, wherein the discharging step comprises:

biasing a clamping device to clamp the low side terminal to a first clamping voltage and to conduct coil current through the clamping device.

27. The method of claim 26, wherein determining the time to discharge the energy stored by the activation coil comprises:

starting a timer responsive to a sensed coil current at the low side terminal reaching the first current level; and stopping the timer responsive to the sensed coil current conducted through the clamping device reaching a second current level.

28. The method of claim 20, wherein the activation coil has a high side at a high side terminal, and has a low side at a low side terminal.

29. The method of claim 28, wherein the step of providing a coil current to the activation coil comprises:

turning on the high-side drive transistor having a conduction path coupled between the high side terminal and a power supply voltage;

biasing the low side drive transistor into an ohmic region, the low side drive transistor having a conduction path coupled between the low side terminal and circuit ground.

30. The method of claim 29, wherein the step of stopping the coil current comprises:

turning off the high-side drive transistor when the coil current reaches the first current level.

31. The method of claim 30, wherein the discharging step comprises:

biasing a clamping device to clamp the low side terminal to a first clamping voltage and to conduct coil current through the clamping device.

32. The method of claim 31, wherein determining the time to discharge the energy stored by the activation coil comprises:

starting a timer responsive to a sensed coil current at the low side terminal reaching the first current level; and stopping the timer responsive to the sensed coil current conducted through the clamping device reaching a second current level.

33. A relay driver, comprising:

a high side terminal adapted to be coupled to a first terminal of an activation coil of a relay;

a low side terminal adapted to be coupled to a second terminal of the activation coil;

one or more drive transistors configured to apply a drive signal at one or more of a high side terminal and a low side terminal;

a clamping device, coupled to the low side terminal and to one or more of a power supply voltage and a circuit ground, and configured to clamp the low side terminal to a selected clamping voltage; and an inductance measurement circuit coupled to the clamping device:

wherein the inductance measurement circuit indicates the activation coil of the relay has a contact failure when a measured inductance of the activation coil is different from an inductance of a relay that does not have a contact failure.

34. The relay driver of claim 33 wherein the inductance measurement circuit includes a timer for measuring the difference between a time at which the low side terminal reaches a first current level and a time when the low side terminal reaches a second current level.

35. The relay driver of claim 33, wherein the one or more drive transistors comprise:

a low side drive transistor having a conduction path coupled between the low side terminal and circuit ground.

36. The relay driver of claim 33, wherein the clamping device comprises:

a clamping transistor having a conduction path coupled between the low side terminal and the power supply voltage;

clamping bias circuitry coupled between the low side terminal and a control terminal of the clamping transistor.

37. The relay driver of claim 36, wherein the clamping bias circuitry further comprises:

a resistor; and a diode, coupled in series with the resistor between the low side terminal and the control terminal of the clamping transistor; and a current source wherein the current source is coupled between the control terminal of the clamping transistor and circuit ground.

38. The relay driver of claim 33 wherein the measured inductance is different by five percent or more from an inductance of a relay that does not have a contact failure.

39. The relay driver of claim 33 wherein the measured inductance is different by ten percent or more from an inductance of a relay that does not have a contact failure.

* * * * *